US010041659B2

(12) United States Patent
Yagi et al.

(10) Patent No.: US 10,041,659 B2
(45) Date of Patent: Aug. 7, 2018

(54) SUBSTRATE FOR MOUNTING LIGHT EMITTING ELEMENT AND METHOD OF FIXING THE SUBSTRATE MEMBER

(71) Applicant: NICHIA CORPORATION, Anan-shi, Tokushima (JP)

(72) Inventors: Toshiyuki Yagi, Yokohama (JP); Toshihiko Aizawa, Anan (JP)

(73) Assignee: NICHIA CORPORATION, Anan-shi (JP)

( * ) Notice: Subject to any disclaimer, the term of this patent is extended or adjusted under 35 U.S.C. 154(b) by 238 days.

(21) Appl. No.: 14/472,528

(22) Filed: Aug. 29, 2014

(65) Prior Publication Data

US 2015/0062933 A1 Mar. 5, 2015

(30) Foreign Application Priority Data

Aug. 30, 2013 (JP) ..... 2013-180401

(51) Int. Cl.

| | |
|---|---|
| ***F21V 19/00*** | (2006.01) |
| *F21V 23/00* | (2015.01) |
| *F21Y 105/10* | (2016.01) |
| *F21Y 115/10* | (2016.01) |

(52) U.S. Cl.

CPC ..... *F21V 19/0055* (2013.01); *F21V 23/004* (2013.01); *F21V 23/006* (2013.01); *F21Y 2105/10* (2016.08); *F21Y 2115/10* (2016.08); *Y10T 29/49126* (2015.01)

(58) Field of Classification Search

CPC ..... F21V 23/06; F21V 23/006; F21V 23/004; F21V 23/773; F21V 19/0055; F21V 19/003; F21K 9/00; F21K 9/20; F21K 9/275; F21Y 2105/10

USPC ..... 362/382, 373, 646, 249.02, 249.01, 365, 362/217.17; 257/88, 89, 98, 99

See application file for complete search history.

(56) References Cited

U.S. PATENT DOCUMENTS

| | | | | |
|---|---|---|---|---|
| 7,638,814 | B2 * | 12/2009 | Wall, Jr. | H01L 33/642 257/100 |
| 8,162,508 | B2 * | 4/2012 | Murakoshi | F21K 9/00 362/249.02 |
| 8,342,733 | B2 * | 1/2013 | Daily | H01R 12/721 362/249.01 |
| 8,449,154 | B2 * | 5/2013 | Uemoto | F21K 9/135 257/98 |
| 8,500,298 | B2 * | 8/2013 | Ogawa | F21K 9/00 362/235 |

(Continued)

FOREIGN PATENT DOCUMENTS

| | | |
|---|---|---|
| JP | 2006-310138 A | 11/2006 |
| JP | 2007-149814 A | 6/2007 |

(Continued)

*Primary Examiner* — Anh Mai
*Assistant Examiner* — Arman B Fallahkhair

(57) ABSTRACT

Disclosed is a substrate for mounting light emitting element with a high positional accuracy and a method of fixing the substrate. A substrate for mounting light emitting element defines a first recess and a second recess in first side in a plan view. The first recess is defined by two corner portions and a straight portion which connects the two corner portions, and the second recess further includes at least two straight portions each narrowing toward the inner end portion.

18 Claims, 5 Drawing Sheets

(56) References Cited

U.S. PATENT DOCUMENTS

| | | | | |
|---|---|---|---|---|
| 9,033,742 | B2 * | 5/2015 | Urano | H01R 12/721 313/318.04 |
| 9,470,409 | B2 * | 10/2016 | Chen | F21K 9/23 |
| 2012/0007076 | A1 | 1/2012 | Cho | |
| 2013/0009179 | A1 * | 1/2013 | Bhat | H05K 1/0209 257/89 |
| 2013/0146937 | A1 | 6/2013 | Omura et al. | |
| 2016/0025276 | A1 * | 1/2016 | Fu | F21K 9/23 362/373 |

FOREIGN PATENT DOCUMENTS

| | | | |
|---|---|---|---|
| JP | 2008-034550 | A | 2/2008 |
| JP | 2008-108079 | A | 5/2008 |
| JP | 2008-218761 | A | 9/2008 |
| JP | 2009-071013 | A | 4/2009 |
| JP | 2012-094842 | A | 5/2012 |
| JP | 2013-038430 | A | 2/2013 |
| WO | 2012-095929 | A1 | 7/2012 |

* cited by examiner

SUBSTRATE FOR MOUNTING LIGHT EMITTING ELEMENT AND METHOD OF FIXING THE SUBSTRATE MEMBER

CROSS-REFERENCE TO RELATED APPLICATIONS

This application claims priority to Japanese Patent Application No. 2013-180401 filed on Aug. 30, 2013. The entire disclosure of Japanese Patent Application No. 2013-180401 is hereby incorporated herein by reference.

TECHNICAL FIELD

The present disclosure relates to a substrate for mounting light emitting element and a method of fixing the substrate.

BACKGROUND

For a light emitting device which is required to exhibits high luminance and/or high output power, a light emitting device equipped with, for example, a plurality of light emitting diodes or laser diodes have been proposed. Such a light emitting device is generally fixed to a fixing substrate which is equipped with a wiring etc. for use so that a cut-out shape and/or a screw hole may be formed in the substrate (for example, see WO-2011-004798 A). Further, at the time of fixing such a light emitting device on a fixing substrate, high positioning accuracy is required according to the purpose of use.

However, there is a limit to the improvement in the positioning accuracy by the form etc., of the cut-out shape and/or the screw hole which is provided in the substrate of the light emitting device, or by the form of the screw attached to the fixing substrate. For example, even with a high positioning accuracy in the cut-out shape and/or the screw hole in the light emitting device, a high-accuracy fixing may be difficult to obtain due to the screw or the like at the fixing substrate side. Also, occurrence of displacement at the time of fixing may result in failure of improvement in positional accuracy. Consequently, warpage may occur in the substrate of the light emitting device, which may cause repetitive expansion and contraction of the substrate of the light emitting device, due to the thermal cycle which occur in use, which may lead breakage or a crack in the substrate. Also, it may resulting in detaching of the light emitting device from the fixing substrate, which may results in a decrease in heat releasing performance of the light emitting device.

SUMMARY

Accordingly, an object of the disclosure is to provide a substrate for mounting light emitting element with high positional accuracy and to a method of fixing the substrate.

The inventors conducted vigorous study on positional relationship between an arrangement of the cut-out shape and/or the screw holes of a substrate in a light emitting device and a type of installation of a screw to a fixing substrate, and on generation of error in positional accuracy in the both. Then the inventors found that adjusting the shapes of the cut-out shape and screw hole and their locational relationship in the substrate of the light emitting device can facilitate positioning of the light emitting device to the fixing substrate. The inventors further found a configuration of the substrate for mounting light emitting element and a method for fixing the substrate with which, even in the case where some errors in positional accuracy are generated in the light emitting device and/or the fixing substrate, the errors can be absorbed maximally.

A substrate for mounting light emitting element according to the embodiments defines a first recess and a second recess in a first side in a plan view. The first recess is defined by two corner portions and a straight portion which connects the two corner portions. The second recess further includes at least two straight portions arranged to approach each other toward the inner end portion of the first recess. A method of fixing a substrate for mounting light emitting element according to an embodiment includes preparing a substrate for mounting light emitting element and a fixing substrate having two screws arranged at a predetermined interval, abutting the screws respectively to two rounded portions at a connection of a straight line portion of the first recess and the second recess on the substrate for mounting light emitting element, and tightening the screws to fix the substrate for mounting light emitting element to the fixing substrate.

According to the embodiments of the present invention, a substrate for mounting light emitting element which can be equipped with a high positional accuracy can be provided. Also, a method of fixing thereof allows mounting of the substrate simply and surely with a high positional accuracy.

DETAILED DESCRIPTION

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

A substrate for mounting light emitting element (hereinafter may also be referred to as a "substrate") according to the embodiments includes, in a plan view, a first recess and a second recess which are defined in a side surface at a first side. Further, the substrate is generally provided with an emission region on which a plurality of light emitting elements are mounted.

Substrate for Mounting Light Emitting Element

The substrate for mounting light emitting element is a planar member and has a certain amount of thickness which is sufficient to support a plurality of light emitting elements.

For this purpose, either rigid or flexible substrate can be employed. The planar outline of the substrate is not specifically limited, and various shapes such as a polygonal shape, a polygonal shape with at least curved side, or the like, can be employed. Among those, a quadrangular shape is preferable. In addition to those shapes, each one or more of shapes such as a recess, a protrusion, a cut-out shape, and/or a hole may be arranged regularly or irregularly (see the substrate 1*a* in FIG. 1C).

The substrate can be made of any appropriate material, examples thereof include an insulating material such as glass, ceramics, resin, wood, pulp, an electrically conductive material such as a semiconductor, a metal (for example, copper, silver, gold, aluminum), and a combination of those. Of those, a metal, ceramics, a resin, or the like, are preferable.

Figure 1A:
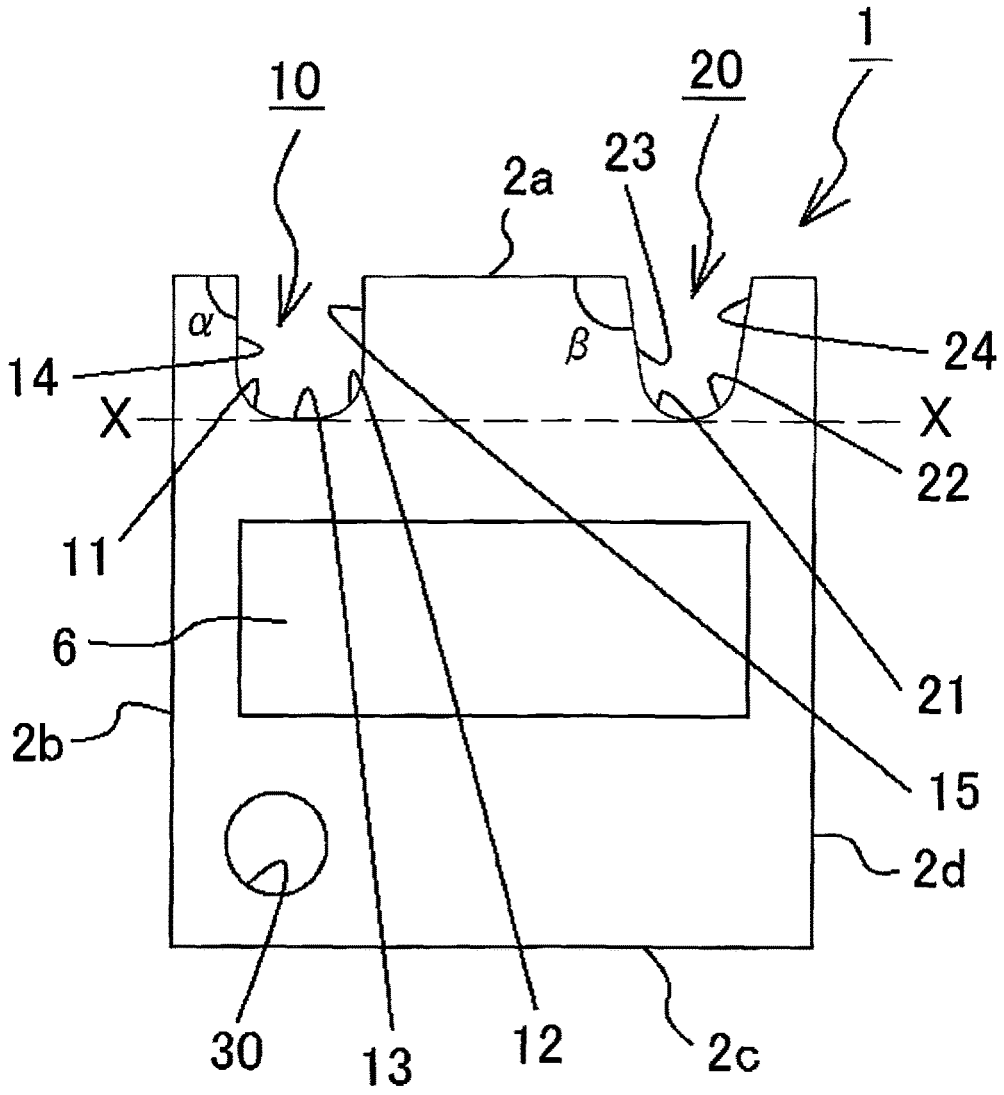
FIG. 1A is a schematic plan view showing an embodiment of a substrate for mounting light emitting element.
Figure 1B:
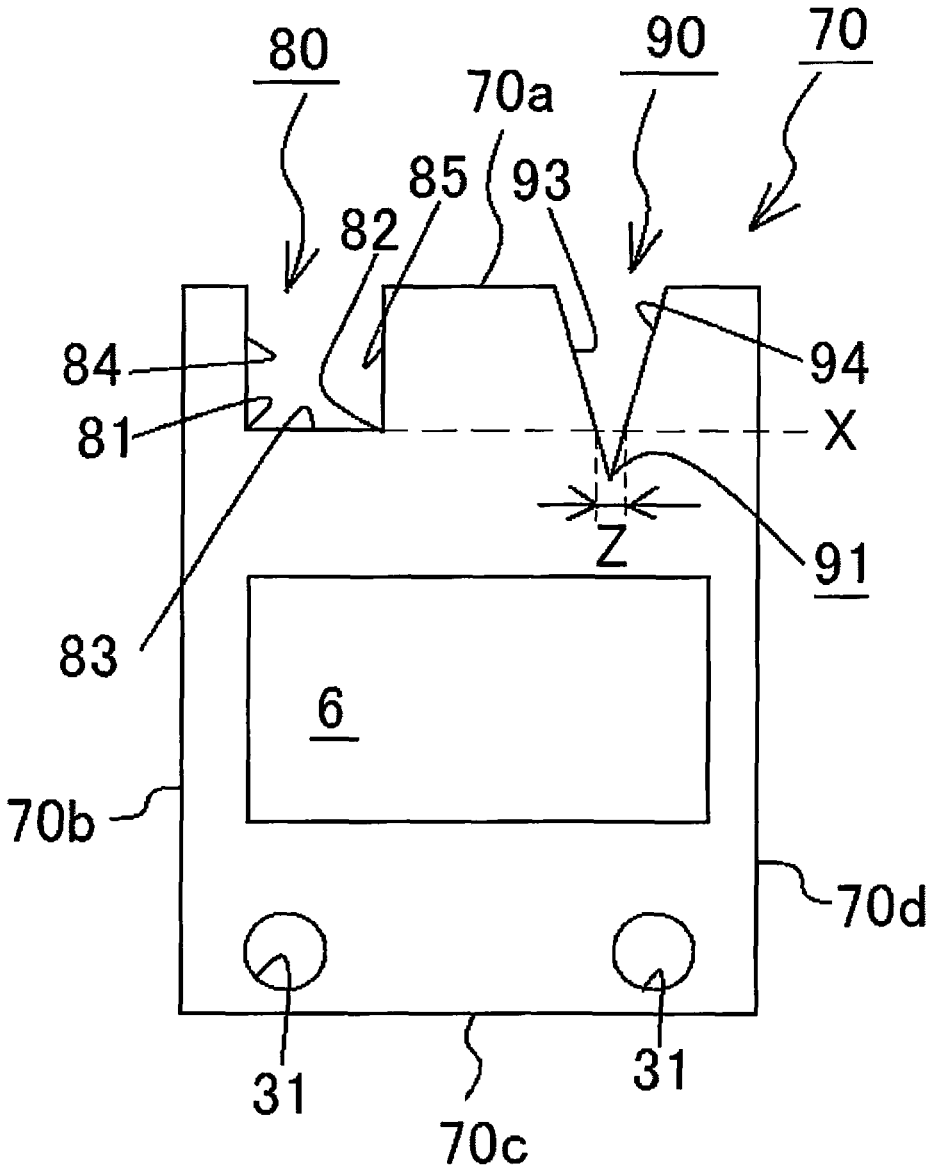
FIG. 1B is a schematic plan view showing another embodiment of a substrate for mounting light emitting element.
Figure 1C:
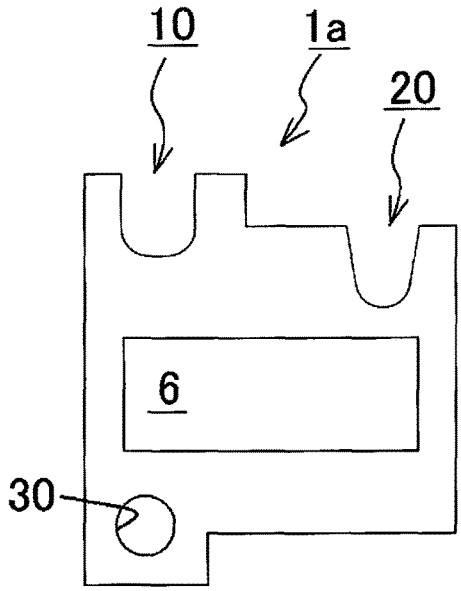
FIG. 1C is a schematic plan view showing further another embodiment of a substrate for mounting light emitting element.

As shown in FIG. 1A, FIG. 1B, etc., the substrate 1, 70 includes, in a plan view, a first recess 10, 80, and the second recess 20, 90, which are defined in the first side. In the specification, the term "first side" refers to the first side 2*a*, 70*a*, in the case where the substrate 1, 70 has an approximate shape of a quadrangule as shown in FIG. 1A or FIG. 1B. Also, in the case where the substrate 1*a* includes a recess and/or a protrusion in its outer circumference, as shown in FIG. 1C, the recess and/or the protrusion can be defined in the same side with respect to the light emitting region 6, that is, the first recess 10 and the second recess 20 may be defined in the first side or may be defined in different sides which indicate different side surfaces defined by different planes at a same side. The first recess and the second recess are, in other words, defined in a side surface (corresponding to the "first side" in a plan view) of a plate-like substrate, and in a plan view of both front surface and back surface of the plate-like substrate, corresponding to the portions which can be seen as cut-out shape portions. The first recess and the second recess are not necessarily defined in a single side surface which is defined by a single plane but may be defined in the side surfaces defined by different planes at a same side with respect to the light emitting region 6, in a similar manner as described above (see FIG. 1C).

In a plan view, the circumference of the first recess may have two corners and straight portion between the two corners. The corners may respectively have a predetermined angle with respect to the straight portion or may be rounded. For example, as shown in FIG. 1A, the circumference of the first recess 10 includes two rounded portions 11, 12 as the corner portions and a straight portion 13 between the two rounded portions 11, 12. Alternatively, as shown in FIG. 1B, the circumference of the first recess 80 includes two right-angled portions 81, 82 as the corner portions and a straight portion 83 between the two rounded portions 81, 82. In the below, the innermost end portion of the first recess 10, 80 within the substrate may be referred to as an "end". The depth (distance) of the first recess 10, 80 from the first side 2*a*, 70*a* to the end is not specifically limited and can be adjusted appropriately according to the size of the screw employed to fix to a fixing substrate. For example, a depth of about 1 time to about 3 times, or about 1.2 times to 1.8 times with respect to the size of the screw may be employed. More specific examples include a depth of about one millimeter to about several centimeters, and about one millimeter to about ten millimeters or about several millimeters to about ten millimeters is preferable.

The width of the first recess 10, 80 in the first side 2*a*, 70*a* is not specifically limited and can be adjusted according to the size of the screw to be used in fixing the substrate to the fixing substrate. For example, the width of about 1 to 3 times or about 1.1 to 1.7 times the diameter of the screw may be employed. More specific examples include a depth of about one millimeter to about several centimeters, and about one millimeter to about ten millimeters or about several millimeters to about ten millimeters is preferable. A curvature radius of the rounded portions 11, 12 may not be specifically limited and is appropriately adjusted according to the screw to be used in fixi9ng to the fixing substrate. For example, a curvature radius of about 0.1 to 2 times or about 0.3 to 1 time with respect to the diameter of the screw to be used can be employed. More specific examples include a curvature radius of about several tenths of millimeter to about several centimeters in which about several tenths of millimeter to about ten millimeters or about one millimeter to about five millimeters is preferable. The rounded portion 11 and the rounded portion 12 may differ in curvature radius, but preferably have a same curvature radius.

The angles of the corners 81, 82 are not specifically limited and may be, for example, about 70° to about 100°, preferably about 80° to about 100° is preferable and a right angle is more preferable. The term "right angle" used herein does not necessarily indicate only an angle of 90° and allows a variation in the angle of about ±5°. Further, in view of processing accuracy, a slightly rounded shape can also be allowed. The corner portions 81 and 82 may have different angles but preferably have a same angle.

The length of the straight portion 13, 83 is not specifically limited and can be appropriately adjusted according to the size of the screw to be used in fixing to the fixing substrate. For example, a length of about 0.1 to about 2 times or about 0.2 to about 1 time with respect to the length of the screw to be used. More specific examples include a depth of about several tenths of millimeter to about several centimeters, preferably about several tenths of millimeter to about ten millimeters or about several tenths of millimeters to about five millimeters.

The first recess 10, 80 may include a first line portion 14, 84 and a second line portion 15, 85, between the first side 2*a*, 70*a* of the substrate 1 and two corner portions 81, 82 or two rounded portions 11, 12. The first line portion 14, 84 and the second line portion 15, 35 may either be a curved line or a serpentine curve, or a straight line. Among those, a straight line is preferable. The first line portion 14, 84 and the corresponding second line portion 15, 85 are preferably approximately in parallel to each other, but at least one of the first line portion 14, 84 and the second line portion 15, 85 may be inclined toward its corresponding corner 81, 82 or rounded portion 11, 12, or both the first line portion 14, 84 and the second line portion 15, 85 may be inclined toward corresponding corners 81, 82 or rounded portions 11, 12, respectively. In other words, at least one of the first line portions 14, 84 and the second first line portion 15, 85 may be inclined with respect to the first side 2*a*, 70*a* so that the width of the first recess portion is decreased toward the end. The inclination angle in the embodiment ($\alpha$ in FIG. 1A) may be about 90±5° with respect to the first side 2*a*, 70*a*, respectively. The inclination angle of the first line portion 14, 84 and the second line portion 15, 85 may be different but are preferably the same. The inclination angle described above is preferably smaller than the inclination angle of the second recesses 20, 90 to be described below.

The first recess preferably has a shape which is symmetrical to the line which passes the center of the straight line portion and perpendicular to the first side, but is not necessarily be symmetrical.

Although depending on the size of the screw which is used to fix to the fixing substrate, the first recess preferably has a size which allows a margin with respect to the screw, in a direction perpendicular to the first side of the substrate and the extending direction of the first side (the directions orthogonal to each other, and hereinafter may be called as "longitudinal direction" and "lateral direction" respectively). In other words, at the time of abutting the screw in the first recess, the screw is brought into contact with the end of the first recess, but still, preferably have a margin which allows for shifting in the lateral direction, that is, shifting in the extending direction of the straight line portion 13. In order to secure such a margin, for example, the straight line portion preferably has a depth of about 100% to about 300% with respect to the diameter of the screw (at thread tops), a curvature radius of about 30% to about 100%, and a length of the straight line portion of about 20% to about 80%, respectively with respect to the screw to be employed. More preferably, the depth of about 100% to about 200% with respect to the diameter of the screw (at thread tops), a curvature radius of about 30% to about 80%, and a length of the straight line portion of about 20% to about 50% may be employed.

With this arrangement, in the case where the screw is abutted to the first recess, while securing a margin in a lateral direction, the screw can be fixed with respect to the lateral direction. Thus, even the two screws are provided on the fixing substrate with variation in positional accuracy, positional adjustment in both lateral and longitudinal directions can be performed with high precision, so that the substrate for mounting light emitting element can be fixed without generating warpage. That is, the straight-line portion 13 of the first recess 10 is preferably substantially in parallel to the first side 2*a* where the first recess 10 and the second recess 20 are arranged.

The second recess in a plan view may include at least two line portions with reducing distance each other toward the inner end portion of the second recess (see the third line portion 23 and the fourth line portion 24 in FIG. 1A, and the third line portion 93 and the fourth line portion 94 in FIG. 1B). In the description below, those line portions may be referred to as "the third line portion" and "the fourth line portion". The third line portion 23, 93 and the fourth line portion 24, 94 may respectively be either a curved line portion, a serpentine curve portion, or a straight line portion, which preferably a straight line portion. At least either one of the third line portion and the fourth line portion is inclined with respect to the first side, with reducing distance from the other line portion toward the end portion, and both line portions are preferably inclined. The inclination angle (β in FIG. 1A) in this case may be greater than 90° and up to about 100° with respect to the first side 2*a*, 70*a*. The inclination angle of the third line portion and the fourth line portion may be different but preferably the same.

The end portion side of the third line portion and the fourth line portion may be rounded and connected with each other (see FIG. 1A), and the two line portions may form an acute angle (see 91 in FIG. 1B). In the specification, the expression "two rounded portions 21, 22 are connected with each other" indicates that the rounded portions adjoin each other without interposing a straight portion. In the below, the innermost end portion of the second recess 20 within the substrate where the rounded portions 21, 22 are connected or create an acute angle may be referred to as an "end". The outer peripheral shape of the substrate at the second recess 20 has a width at the end smaller than the width at the first side 2*a*, 70*a*.

The second recess 20, 90 has a depth which is a distance between the first side 2*a*, 70*a* to the end, of, for example, about one millimeter to about several centimeters, which is preferably about one millimeter to about ten millimeters or about several millimeters to about ten millimeters. Particularly, the second recess 20 has a same depth as that of the first recess 10. In other words, a virtual straight line between the straight portion 13 of the first recess 10 and the connecting portion of the two rounded portion 21, 22 is preferably in parallel to the first side 2*a* where the first recess and the second recess are arranged.

Alternately, the second recess 90 is preferably deeper than the first recess 80. The depth can be appropriately adjusted according to the size of the screw which is used for fixing to a fixing substrate. The second recess 90 is preferably deeper, by about several percent to about several tens of percent than the depth of the first recess 80. In both cases, the width of the second recess at a location corresponding to the end portion of the first recess, that is, for example as shown in FIG. 1A, the width of the second recess at a location X where the straight portion of the first recess is located, is preferably smaller than the length of the straight portion of the first recess. For example, in FIG. 1A, the connection portion between the rounded portion 21 and the rounded portion 22 preferably have a somewhat point-like shape and thus have a smaller length than the length of the straight portion 13. In FIG. 1B, at a position indicated by the virtual line X, which is in conformity with the straight portion 83 of the first recess, the length of the straight portion 83 is preferably longer than the width Z of the second recess. Although depending on the size of the screw which is used to fix to the fixing substrate, the width may be, for example, about a half millimeter to about several centimeters, and about one millimeter to about ten millimeters or about one millimeters to about five millimeters is preferable.

The width of the second recess 20, 90 at the first side 2*a*, 70*a* may be about one millimeter to about several centimeters, and about one millimeter to about ten millimeters, or about several millimeters to about ten millimeters are preferable. The width of the second recess 20, 90 at the first side 2*a*, 70*a* is preferably the same as the width of the first recess 10, 80, respectively.

The rounded portion 21, 22 may have a curvature radius of about several tenths of millimeters and about several tenths of millimeters to about ten millimeters or about one millimeter to about five millimeters is preferable. The rounded portion 21 and the rounded portion 22 may differ in curvature radius [radius of curvature], but preferably have a same curvature radius. Further, the rounded portion 21, 22 may have a curvature radius which is different than that of the rounded portion 11, 12, but preferably have the same curvature radius.

The second recess is preferably symmetrical to a virtual line which passes the connecting portion between the rounded portions 21 and 22 or the apex of an acute angle between the rounded portions 21, 22 and which is perpendicular to the first side 2*a*, 70*a*, but is not limited to this configuration.

Although depending on the size of the screw used for fixing to the fixing substrate, the second recess preferably include a margin to the screw in both lateral and longitudinal directions at the entrance of the second recess, but allows for fixing the screws in the lateral direction at respectively appropriate locations at the time of engaging the screws in the second recess. In order to secure such a margin, the second recess may be defined with a depth of about 100% to about 300% with respect to the diameter of the screw (at the thread tops) and a curvature radius of about 30% to about 100% with respect to the curvature radius of the rounded portions, and more preferably defined with a depth of about 100% to about 200% with respect to the diameter of the screw (at the thread tops) and a curvature radius of about 30% to about 80% with respect to the curvature radius of the rounded portions.

With this arrangement, in the case where the screws are abutted to the first recess and the second recess respectively, the screws can be fixed to respective appropriate locations in a lateral direction while one of the screws is abutting to the end along the inclined third line portion and/or fourth line portion with securely maintaining a longitudinal margin. Thus, as described above, even in the case where the two screws are provided on the fixing substrate with a variation in the positional accuracy, the substrate for mounting light emitting element can be fixed while allowing high accuracy adjusting locations in the longitudinal and lateral directions without generating warpage in the substrate for mounting light emitting element.

The substrate 1 preferably has, as shown in FIG. 1A or FIG. 1B, a through hole 30, 31 or a third recess at a location which is spaced apart from the side 2*a*, 70*a* which defines the first recess 10, 80 and the second recess 20, 90, respectively. At least each one of the through hole 30, 31 or the third recess is to be provided. In the specification, "the expression "location which is spaced apart from the side 2*a* which defines the first recess 10 and the second recess 20" indicates a location closest to a side which is different from that side 2*a* which defines toe first recess 10 and the second recedss 20. The different side may adjoin the side 2*a* (a side 2*b* or a side 2*d* in FIG. 1A, a side 70*b* or a side 70*d* in FIG. 1B), but for example, in the case where the substrate 1 includes a side 2*c* (or 70*c*) which is the opposite side to the side 2*a* which defines the first recess 10 and the second recess 20, the side 2*c* is preferable. The third recess is defined in the plane shown as the different side in plan view as described above, which may be either the side 2*c* which is at the opposite side from the first side 2*a* where the first recess 10 and the second recess 20 are defined, or the side 2*b*, 2*d*, and the like, which adjoins the one side 2*c*.

The through-hole 30 or the third recess is preferably arranged at an opposite side of the interposing a light emitting region 6 to be described below, substrate 1 with respect to the first recess 10 and the second recess 20. The greater the distance between the both, the degree in the positional error at the time of fixing can be reduced.

The through hole 30 may have a circular shape or an oval shape, and the size can be appropriately adjusted according to the screws to be used. For example, the through hole 30 preferably defined in a circle or an oval (i.e. shorter axis) with a diameter of 100 to 150% with respect to the diameter of the screws, and further, 110 to 150% is more preferable. The third recess may be defined with a shape similar to that of the first recess and/or the second recess, with a range of size which is exemplified above. With the through hole or the third recess as described above, the substrate can be prepared with high positional accuracy by using the first recess and the second recess and can be firmly fixed to the fixing substrate.

The substrate 1 further includes a light emitting region 6 where the light emitting element is disposed. In the light emitting region 6, a plurality of light emitting elements are mounted. The light emitting elements are not specifically limited, and light emitting elements of various semiconductor layers and various emission wavelengths which are generally used in the art can be employed. For example, the light emitting elements are preferably arranged in rows, in lines or in matrix. The number of the light emitting element to be arranged may be one to several tens versus one to several tens, for example. The type of connection used in connecting the light emitting elements is not specifically limited and a connection which includes one or more lines arranged in series, in parallel, in serial parallel mixture, or in parallel serial mixture. Among those, a circuit which includes serial parallel mixture, or parallel serial mixture, more specifically, a plurality of two parallel versus ten serial is preferable. With such a connection configuration, upon occurrence of conduction failure in one emitting element, or randomly in a plurality of light emitting elements, conduction failure in the circuit which does not include those light emitting elements can be avoided.

The substrate 1 generally has a plurality of light emitting elements on its light emitting region 6 and is provided with a circuit pattern to connect the light emitting elements as described above. Such a circuit pattern may be disposed on the substrate 1 or a base member which has a circuit pattern disposed thereon is loaded on the substrate 1. The circuit pattern is not specifically limited as long as it is generally used for electrically connecting light emitting elements, and a material known in the art (for example, a thin layer of copper or aluminum with a thickness of several micrometers to several hundred micrometers) which is formed by way of a known method can be employed.

The substrate may further include a protective element such as a capacitor, a varistor, a Zener diode, or a bridge diode, or an overheating preventing element such as a thermistor. In order to ensure heat dissipation, portion or member which has good heat dissipation may be exposed, or a connector to an external power source or the like may be provided. With such an arrangement, a light emitting device of high performance with improved electrostatic withstand voltage can be obtained while realizing miniaturization of the device.

Fixing Method of Substrate for Mounting Light Emitting Element

In a method of fixing the substrate for mounting light emitting element according to the embodiments, first, a substrate for mounting light emitting element and a fixing substrate which is provided with two screws arranged at a predetermined interval are prepared. The fixing substrate is generally a substrate for mounting a light emitting device or the like, and has a circuit pattern etc., on its surface when appropriate. The fixing substrate can be made of any appropriate material, examples thereof include an insulating material such as glass, ceramics, resin, wood, pulp, an electrically conductive material such as a semiconductor, a metal (for example, copper, silver, gold, aluminum), and a combination of those. Two screws may be arranged with an interval corresponding to the interval between the first recess and the second recess of the substrate for mounting light emitting element as described above. For example, such an interval as described above id determined according to the size of the substrate for mounting light emitting element, and for example, about 10 mm to about 100 mm, further, about 15 mm to about 50 mm may be employed. The size of the screws can be selected according to the size of the substrate for mounting light emitting element to be fixed, and the diameter at the thread tops of about several tenths of millimeter to about ten millimeters, about one millimeter to about five millimeters may be employed.

Next, the screws of the fixing substrate are respectively abutted to the straight portion in the first recess and at least one straight line portion or two rounded portions which are connected with each other in the second recess of the substrate. Generally, the first recess can be easily abutted to the straight portion where the screw is the end, but the second recess may have a width narrowing from the one end side to the end, so that the screws may not necessarily be abutted to the two rounded portions in the second recess. In this case, at least within the second recess, the screw of the fixing substrate is preferably abutting to one of the rounded portions and either the third line portion or the fourth line portion, or one of or both the third line portion and the fourth line portion, preferably one of the connecting portions between the rounded portions and the corresponding third portion or fourth portion, or both of the connecting portions between the rounded portions and the corresponding third line portion or fourth line portion. In the second recess, a straight portion which is shorter than the diameter of the screw can be arranged between the two rounded portions, provided that the screw is abutted to one of the rounded portions and either the third line portion or the fourth line portion, one of or both the third line portion and the fourth line portion, one of the connecting portions between the rounded portions and the corresponding third portion or fourth portion, or both of the connecting portions between the rounded portions and the corresponding third line portion or fourth line portion.

As described above, the screws of the fixing substrate are abutted to the portions of the first recess and the second recess respectively, thus allows fixing of the position in the longitudinal direction by using the first recess which is defined with a relatively wide width, and also fixing of the position in the lateral direction by using the second recess, abutting the screw at least one location between the opening to the end of the second recess, preferably abutting the screw at the end of the second recess. Accordingly, positioning can be achieved with a high accuracy.

Then, the screws are tightened to fix the substrate for mounting light emitting element to the fixing substrate. Accordingly, the substrate for mounting light emitting element can be fixed to the fixing substrate with high accuracy positioning as described above. As a result, even in the case where some positional error occur at one or both of the two screws in the fixing substrate, the substrate can be fixed to the fixing substrate without generating warpage in the substrate in a direction along the side where the first recess and the second recess are defined in the substrate for mounting light emitting element. Accordingly, the substrate for mounting light emitting element can be prevented from detaching from the fixing substrate and the heat dissipation performance can be secured.

Moreover, high-accuracy positioning described above can be performed in a short time, which allows for easy and simple fixing of the substrate for mounting light emitting element. Such easy and simple fixing to the fixing substrate can be performed not only at the time of manufacturing but also at the time of replacement of the substrate for mounting light emitting element.

In the case where the substrate for mounting light emitting element includes a through hole or a third recess, after abutting the screws to the first recess and the second recess respectively, a screw is engaged in the through hole or the third recess and fixed, thus the substrate for mounting light emitting element can be fixed firmly. The order of tightening the screw for fixing is not specifically limited, but in the present embodiment, the screws are preferably tightened at either the first recess or the second recess which has a greater distance to the through hole or the third recess (the second recess in FIG. 1A) and the through hole or the third recess, then tightened at the first recess, to obtain highest accuracy in mounting.

Embodiments of a substrate for mounting light emitting element will be described in detail below with reference to accompanying drawings.

Embodiment 1

Figure 2:
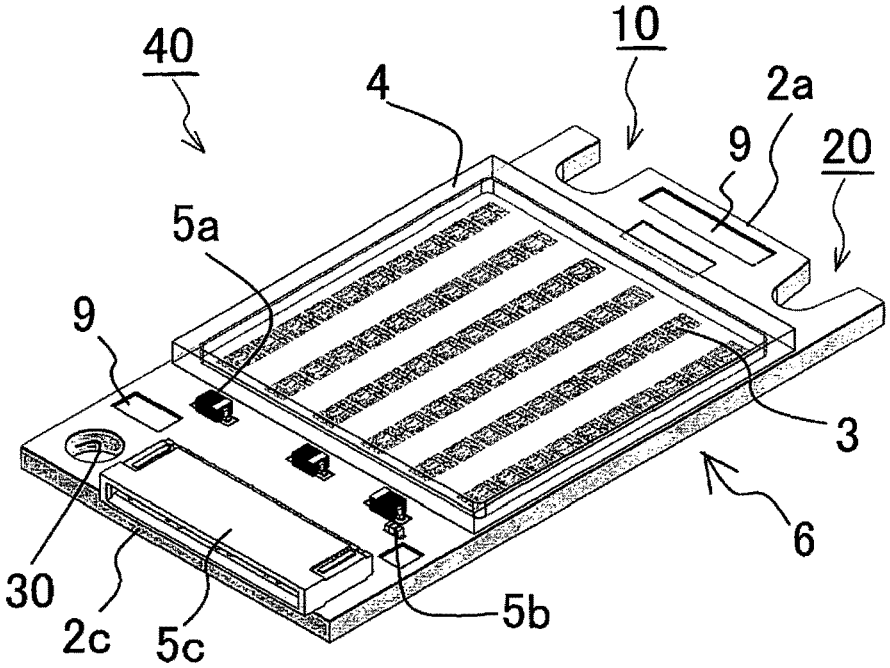
FIG. 2 is a schematic plan view showing another embodiment of a substrate for mounting light emitting element.

As shown in FIG. 2, a substrate for mounting light emitting element 1 according to the present embodiment has, in a plan view, an appropriately rectangular shape of 25 mm×45 mm with a thickness of 4.5 mm and made of aluminum. In a plan view, the peripheral shape of the substrate 1 includes a first recess 10 and a second recess 20 at a first side 2*a*.

Figure 3:
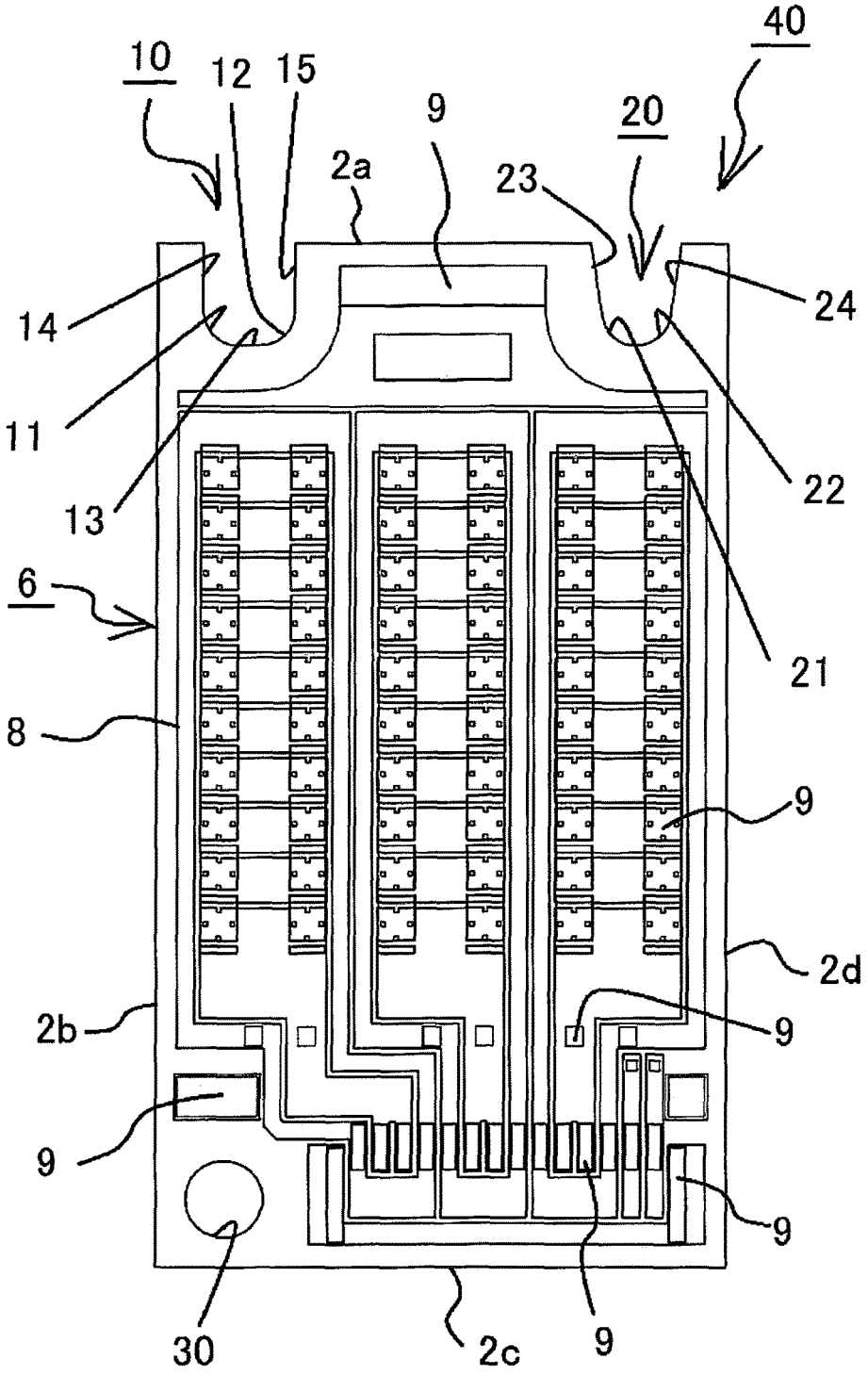
FIG. 3 is a schematic perspective view of the substrate for light emitting element shown in FIG. 2.

The substrate 1 has a circuit pattern (reference numeral 9 in FIG. 3) on its upper surface and a plurality of light emitting elements 3 each connected to the circuit pattern are arranged on the wiring pattern to form a light emitting region 6. The plurality of light emitting elements 3 are mounted in subsets, for example, three subsets of a connection type of 10 in series ×2 in parallel may be mounted. A light transmissive member 4 made of glass is applied over the light emitting region 6 to protect the light emitting elements. A through hole 30 is defined close to the side 2*c* which is at the opposite side of the first side 2*a* of the substrate 1. The through-hole 30 or the third recess is preferably arranged at an opposite side of the interposing a light emitting region 6 to be described below, substrate 1 with respect to the first recess 10 and the second recess 20. A protective element 5*a* which is connected to each circuit pattern is disposed on the substrate 1. Further, a thermistor 5*b* and a connector 5*c* which are connected to the circuits are mounted on the substrate 1. Also, on the substrate 1, a portion of the circuit pattern may be exposed from the substrate to improve heat dissipating property As shown in FIG. 3, the first recess 10 of the substrate 1 includes two rounded portions 11, 12 and a straight portion 13 between the two rounded portions 11, 12. The rounded portions 11, 12 have a same curvature radius, which is, for example, about 1.5 mm in the present embodiment. The straight portion 13 has a length of about ⅔ of the curvature radius of the rounded portion 11, 12, which is, for example, about 1 mm in the present embodiment.

The first recess 10 may include a first line portion 14 and a second line portion 15 between a first side 2*a* of the substrate 1 and two corner portions 11, 12. The first line portion 14 and the second line portion 15 have a length about twice the curvature radius of the rounded portions 11, 12, which is, for example, about 3 mm in the present embodiment. Accordingly, the first recess 10 has a depth from the first side 2*a* to the end of, for example, about 1.5 times with respect to the diameter of the screw thread tops as described below, which is, for example, about 4.5 mm in the present embodiment. The first line portion 14 and the second line portion 15 perpendicularly intersect with the first side 2*a* of the substrate 1.

The second recess 20 includes two rounded portions 21, 22 which are connected with each other. The rounded portions 21, 22 have a same curvature radius. Also, the rounded portions 21, 22 have a same curvature radius as that of the rounded portions 11, 12. The second recess 20 may include a third line portion 23 and a fourth line portion 24 between the first side 2*a* of the substrate 1 and two rounded portions 21, 22, with reducing distance between the third line portions 23 and the fourth line portions 24 toward the rounded portions 21, 22.

The third line portion 23 and the fourth line portion 24 are respectively inclined at 99 degrees with respect to the first side 2*a* of the substrate 1 (see β in FIG. 1A). The first recess 10 and the second recess 20 have a same width at the first side 2*a*, which is about 4 mm in the present embodiment. The first recess 10 and the second recess 20 have a same depth.

On the entire surface of the substrate 1, a film made of a glass cloth impregnated with an epoxy resin is disposed and a circuit pattern 9 made of a copper foil is disposed on its surface with a predetermined shape. On the circuit pattern 9, each of the light emitting elements 3 is mounted in a face-up manner, in which one of the electrodes of each light emitting element 3 is wire-bonded to the circuit pattern 9 and the other electrode is connected to the circuit pattern 9 via a bonding member such as a solder. Further, the region which includes the circuit pattern 9 except for the regions on which the light emitting elements 3 are mounted, a silicone resin layer which contains titanium oxide is disposed as a reflective layer 8.

As described above, with the arrangement of the first recess and the second recess at the first side of the substrate, in the case where the screws attached to the fixing substrate are abutted to the first recess and the second recess respectively, the screws can be fixed to respective appropriate locations in a lateral direction while one of the screws is abutting to the end along the inclined third line portion and/or fourth line portion with securely maintaining a longitudinal margin. Thus, regardless of the variation in the positional accuracy in the two screws provided on the fixing substrate, the substrate for mounting light emitting element can be fixed while allowing high accuracy adjusting locations in the longitudinal and lateral directions without generating warpage in the substrate for mounting light emitting element.

The substrate for mounting light emitting element 1 according to the present embodiment can be fixed on a fixing substrate which is provided with two screws arranged at a predetermined interval, as described below. First, a substrate for mounting light emitting element 1 is prepared, and also a fixing substrate (made of a glass epoxy resin) provided with two screws (a diameter of 3 mm at thread tops) at a predetermined interval, for example, an interval of 13 mm, is prepared.

Next, the screws of the fixing substrate are respectively abutted to the straight portion in the first recess and two rounded portions which are connected with each other in the second recess of the substrate. As described above, the screws of the fixing substrate are abutted to the portions of the first recess and the second recess respectively, thus allows fixing of the position in the longitudinal direction by using the first recess which is defined with a relatively wide width, and also fixing of the position in the lateral direction by using the second recess, abutting the screw at least one location between the opening to the end of the second recess, preferably abutting the screw at the end of the second recess. Accordingly, positioning can be achieved with a high accuracy.

Then, the screws are tightened to fix the substrate for mounting light emitting element to the fixing substrate. Accordingly, the substrate for mounting light emitting element can be fixed to the fixing substrate with high accuracy positioning as described above. As a result, even in the case where some positional error occur at one or both of the two screws in the fixing substrate, the substrate can be fixed to the fixing substrate without generating warpage in the substrate in a direction along the side where the first recess and the second recess are defined in the substrate for mounting light emitting element. Accordingly, the substrate for mounting light emitting element can be prevented from detaching from the fixing substrate and the heat dissipation performance can be secured. Moreover, high-accuracy positioning described above can be performed in a short time, which allows for easy and simple fixing of the substrate for mounting light emitting element on the fixing substrate. Such easy and simple fixing to the fixing substrate can be performed not only at the time of manufacturing but also at the time of replacement of the substrate for mounting light emitting element in the maintenance.

Next, a screw is engaged in the through hole 30 of the substrate 1 and fixed, thus the substrate for mounting light emitting element can be fixed firmly.

Variational Example of Embodiment 1

As shown in FIG. 1B, a substrate for mounting light emitting element 70 according to the present embodiment has, in a plan view, an appropriately rectangular shape of 25 mm×45 mm with a thickness of 4.5 mm and made of aluminum. In a plan view, the substrate 70 has a peripheral shape substantially similar to that in Embodiment 1, except that a first recess 80 and a second recess 70 are arranged at first side 70*a*, and two through holes 31 are arranged respectively close to a side 70*c* which is at the opposite side to the first side 70*a* of the substrate 70.

The first recess 80 of the substrate 70 is defined with two substantially right angled corners 81, 82 and a straight portion 83 between the two corners. The straight portion 83 has a length of, for example, about 1.8 mm. The first recess 80 may include a first line portion 84 and a second line portion 85 which are substantially in parallel to each other and arranged between a first side 70*a* of the substrate 70 and two corner portions 81, 82. The first line portion 84 and the second line portion 85 respectively have a length of, for example, about 4.5 mm. The first line portion 84 and the second line portion 85 are respectively perpendicular to the first side 70*a* of the substrate 70. For the first recess 80, the first recess 10 of Embodiment 1 may be employed, or for the first recess 10 of Embodiment 1, the first recess 80 may be employed, in combination of the second recess.

The second recess 90 may include a third line portion 93 and a fourth line portion 94 which are inclined with reducing distance from each other toward the inner end portion of the second recesses portion 90. The third line portion 93 and the fourth line portion 94 are respectively inclined at 110 degrees with respect to the first side 70*a* of the substrate 70, and form an acute angle of 40 degrees at the end portion. The first recess 80 and the second recess 90 have a same width at the first side 70*a*, which may be about 4 mm in the present embodiment. The ratio of the depth of the first recess 80 and the depth of the second recess 90 may be 1:12.

According to the present variational example, a similar effects as in Embodiment 1 can be exhibited.

In the case where the substrate for mounting light emitting element 7 according to the present embodiment is fixed on a fixing substrate which is provided with two screws arranged at a predetermined interval, the screws of the fixing substrate are respectively abutted to the straight portion in the first recess and at least one of straight line portion or two rounded portions which are connected with each other in the second recess of the substrate, and then in a similar manner as in Embodiment 1, the substrate for mounting light emitting element can be fixed on a fixing substrate which is provided with two screws at a predetermined interval. Compared to the present variational example, Embodiment 1 does not require an excess amount of depth in the second recess 20 and the first recess 10 and the second recess 20 have a same depth. Accordingly, in the substrates of a certain size, the substrate according to Embodiment 1 allows for a larger light emitting region, and thus preferable.

Embodiment 2

Figure 4:
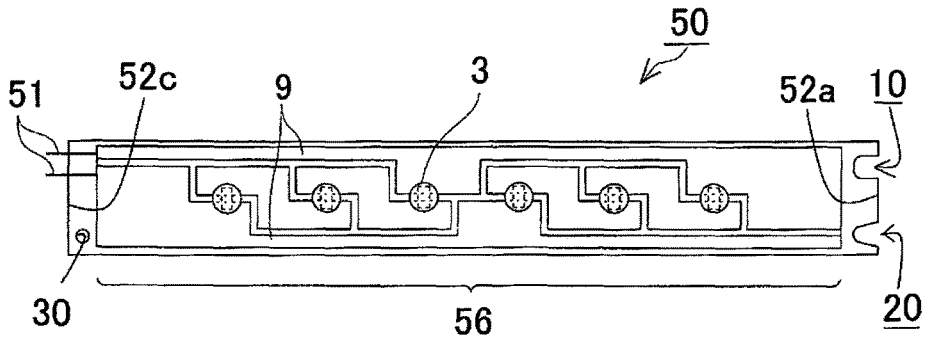
FIG. 4 is a schematic plan view showing further another embodiment of a substrate for mounting light emitting element.

As shown in FIG. 4, a substrate for mounting light emitting element 50 according to the present embodiment has, in a plan view, an appropriately rectangular shape of 15 mm×1150 mm with a thickness of about 0.1 mm and made of a flexible polyimide. In a plan view, the peripheral shape of the substrate 50 includes a first recess 10 and a second recess 20 at a first side 52*a*. The substrate 50 has a circuit pattern 9 which is made of a copper foil on its upper surface and a plurality of light emitting elements 3 each connected to the circuit pattern 9 are arranged on the circuit pattern 9 to form a light emitting region 56. The plurality of light emitting elements 3 are mounted in subsets, for example, one subset of a connection type of 3 in series ×2 in parallel may be mounted.

Also, a through hole 30 is defined close to the side 52*c* which is at the opposite side of the first side 52*a* of the substrate 50. The through-hole 30 or the third recess is preferably arranged at an opposite side of the interposing a light emitting region 56 to be described below, substrate 50 with respect to the first recess 10 and the second recess 20. Further, a connector 51 is disposed on the circuit pattern 9 on the substrate 50.

The shapes of the first recess 10 and the second recess 20 of the substrate 50 are substantially similar to that formed in the substrate 40 in Embodiment 1, except for the dimensions are reduced to ⅗ of that in Embodiment 1. Also, the dimensions of the through hole 30 is substantially similar to that shown in Embodiment 1. Accordingly, fixing to the fixing substrate can be obtained in a similar manner as in Embodiment 1, and thus substantially similar effects and performance as in Embodiment 1 can be obtained.

Embodiment 3

Figure 5:
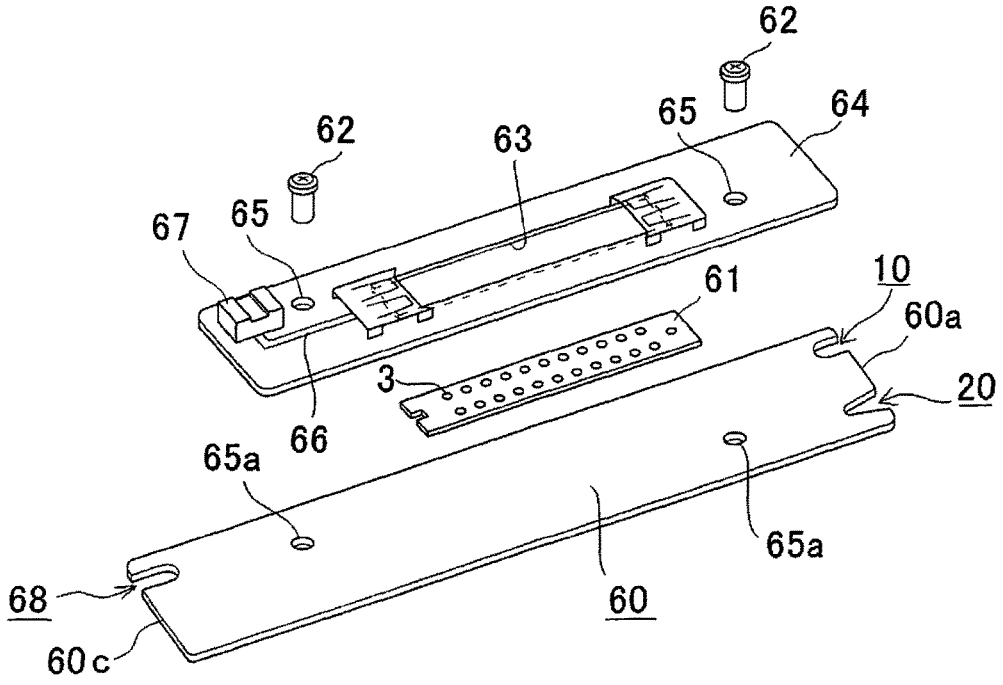
FIG. 5 is a schematic exploded perspective view of yet another embodiment of a substrate for mounting light emitting element.

A substrate for mounting light emitting element 60 according to Embodiment 3 is made of a material which has good heat conductivity and as shown in FIG. 5, a first recess 10 and a second recess 20 are defined in a first side 60*a* of an approximately rectangular shape. A third recess 68 is defined close to the side 60*c* which is at the opposite side of the first side of the substrate 60.

The shapes of the first recess 10 and the second recess 20 of the substrate 60 are substantially similar to that formed in the substrate 60 in Embodiment 1. Also, the dimensions of the through hole 30 is substantially similar to that shown in Embodiment 1. Accordingly, fixing to the fixing substrate can be obtained in a similar manner as in Embodiment 1, and thus substantially similar effects and performance as in Embodiment 1 can be obtained.

A ceramic substrate 61 with a plurality of light emitting elements 3 mounted thereon is engaged to a light transmissive substrate 64 to an opening 63 defined in the ceramic substrate 61, and the engaged members are then stacked on the substrate 60. The ceramic substrate 61 and the light transmissive substrate 64 are pressure held to the substrate 60 with one or more plate springs or screws 62.

The light transmissive substrate 64 may be a printed substrate, constituted with a circuit pattern 66, which is partially shown in FIG. 5, and a connector 67 on a glass epoxy resin, and also can serve as an end. The light transmissive substrate 64 defines screw holes 65, the ceramic substrate 61 is engaged to the light transmissive substrate 61, and the screws 62 are inserted to the holes 65*a* in the screw holes and the holes 65*a* of the substrate 60 and fixed. The ceramic substrate 61 may be made of a planar material which has a high heat conductivity such as aluminum oxide ($Al_2O_3$). A circuit pattern is formed on the upper surface and a plurality of light emitting elements 3 are connected to the circuit pattern, in an arrangement of, for example, two in parallel ×12 in series.

INDUSTRIAL APPLICABILITY

The light source device according to the present invention can be used for various kinds of light sources, such as projectors, illumination light sources, light sources for various kinds of indicators, light sources for automobile use, light sources for displays, back light sources for liquid crystal displays, signals, automobile use, channel control characters for channel boards. As described above, it should be obvious that various other embodiments are possible without departing the spirit and scope of the present invention. Accordingly, the scope and spirit of the present invention should be limited only by the following claims.

What is claimed is:

1. A substrate for mounting a light emitting element comprising:

an outer peripheral edge surface having a first section that includes a first recess and a second recess, with the first recess and the second recess opening outward in a same direction of the substrate at the first section of the outer peripheral edge surface, the first recess including two corner portions, and a straight portion connecting the two corner portions, and the second recess including at least two straight line portions, and an inner end portion, and the second recess narrowing toward the inner end portion; and a depth direction running from an opening of the second recess to the inner end portion of the second recess, the straight portion of the first recess having a length greater than the width of the second recess at a depth in the depth direction, the depth corresponding to a position of the straight portion of the first recess relative to the first section of the outer peripheral edge surface.

2. The substrate for mounting a light emitting element according to claim 1, further comprising:

a third aperture disposed away from the first section of the outer peripheral edge surface, and being either a through hole or a third recess.

3. The substrate for mounting a light emitting element according to claim 2, wherein:

the outer peripheral edge surface further has a second section that is disposed on a different side from the first section; and the third aperture is disposed proximate to, or into, the second section.

4. The substrate for mounting a light emitting element according to claim 2, wherein:

the outer peripheral edge surface further has a second section that is disposed on an opposite side of the substrate for mounting a light emitting element from the first section;

the light emitting region is disposed between the first section and the second section; and the third aperture is disposed proximate to, or into, the second section.

5. The substrate for mounting a light emitting element according to claim 1, further comprising a light emitting region in which the light emitting element is to be mounted, wherein the second recess narrows toward an inner end portion, at least one of the two straight line portions of the second recess extends in a direction that is inclined with respect to a direction along which the straight portion of the first recess extends, and a connector region in which a connector for the light emitting element is to be mounted is arranged on an opposite side of the first section, with the light emitting region being arranged between the first section and the connector region.

6. The substrate for mounting a light emitting element according to claim 1, wherein:

the second recess further includes two rounded portions which are connected with each other between the two straight line portions.

7. The substrate for mounting a light emitting element according to claim 1, wherein:

the two straight line portions of the second recess intersect with respect to each other at an acute angle at the inner end portion.

8. The substrate for mounting a light emitting element according to claim 1, wherein:

the two corner portions of the first recess are rounded.

9. The substrate for mounting a light emitting element according to claim 1, wherein:

the first recess has a first depth measured from an opening of the first recess at the first section of the outer peripheral edge surface to the straight portion;

the second recess has a second depth measured from an opening of the second recess at the first section of the outer peripheral edge surface to the inner end portion; and the first depth and the second depth are equal.

10. The substrate for mounting a light emitting element according to claim 1, wherein:

the first recess and the second recess have a same width at the first section of the outer peripheral edge surface along an outer peripheral direction of the outer peripheral edge surface.

11. The substrate for mounting a light emitting element according to claim 1, wherein:

the first recess includes, between the first section of the outer peripheral edge surface and the two rounded portions, a first line portion and a second line portion which are approximately in parallel with each other or at least one of the first line portion and the second line portion inclines toward the rounded portion.

12. The substrate for mounting a light emitting element according to claim 1, wherein:

at least one of the two straight line portions of the second recess has a line portion that is inclined toward the inner end portion.

13. A method of fixing a substrate for mounting a light emitting element comprising:

preparing a substrate for mounting a light emitting element according to claim 1;

preparing a fixing substrate having two screws arranged at a predetermined interval;

abutting the screws of the fixing substrate respectively to a straight portion of the first recess and at least one straight line portion or two rounded portions which are connected with each other in the second recess on the substrate for mounting a light emitting element; and tightening the screws to fix the substrate for mounting a light emitting element to the fixing substrate.

14. A method of fixing a substrate for mounting a light emitting element comprising:

preparing a substrate for mounting a light emitting element according to claim 1;

preparing a fixing substrate having two screws arranged at a predetermined interval;

abutting the screws of the fixing substrate respectively to a straight portion of the first recess and the second recess on the substrate for mounting a light emitting element; and tightening the screws to fix the substrate for mounting a light emitting element to the fixing substrate.

15. The substrate for mounting a light emitting element according to claim 1, wherein the substrate having an elongated shape with the first section being arranged on one short side of the substrate and the connector region being arranged adjacent to another short side of the substrate.

16. The substrate for mounting a light emitting element according to claim 1, wherein a depth direction running from opening of the first recess to the straight portion is parallel to a depth direction running from opening of the second recess to the inner end portion of the second recess.

17. The substrate for mounting a light emitting element according to claim 1, wherein the straight line portion of the first recess is parallel to the outer peripheral edge in the first section where the first recess is formed.

18. The substrate for mounting a light emitting element according to claim 1, wherein the inner end portion of the second recess is constituted by a single point disposed farthest from the outer peripheral edge surface.

* * * * *